US008126389B2

(12) United States Patent
Brown et al.

(10) Patent No.: US 8,126,389 B2
(45) Date of Patent: Feb. 28, 2012

(54) APPARATUS AND METHOD FOR INTERFERING WITH WIRELESS COMMUNICATIONS DEVICES IN RESPONSE TO TRANSMISSION POWER DETECTION

(75) Inventors: Craig S. Brown, Bainbridge Island, WA (US); Joveliano C. Trinidad, Bainbridge Island, WA (US)

(73) Assignee: D3T, LLC, Seattle, WA (US)

( * ) Notice: Subject to any disclaimer, the term of this patent is extended or adjusted under 35 U.S.C. 154(b) by 894 days.

(21) Appl. No.: 12/110,077

(22) Filed: Apr. 25, 2008

(65) Prior Publication Data

US 2008/0268769 A1 Oct. 30, 2008

Related U.S. Application Data

(60) Provisional application No. 60/914,666, filed on Apr. 27, 2007.

(51) Int. Cl.
*H04K 3/00* (2006.01)

(52) U.S. Cl. ..... 455/1; 455/456.4; 455/411; 455/545; 340/5.2; 340/438; 340/439

(58) Field of Classification Search ..... 455/1, 441, 455/63.1, 67.11, 420, 423, 425, 452.2, 10, 455/13.4, 67.13, 552.1, 99, 556.1, 115.1, 455/114.2, 297, 414.1, 410, 404.1, 418, 456.4, 455/421, 411, 403; 340/438, 439, 5.2; 701/33, 701/36, 1; 342/357.07

See application file for complete search history.

(56) References Cited

U.S. PATENT DOCUMENTS

| | | | | |
|---|---|---|---|---|
| 6,690,940 | B1 * | 2/2004 | Brown et al. | 455/456.4 |
| 6,697,013 | B2 * | 2/2004 | McFarland et al. | 342/159 |
| 6,771,946 | B1 | 8/2004 | Oyaski | 455/345 |
| 7,123,874 | B1 * | 10/2006 | Brennan | 455/1 |
| 2003/0107512 | A1 * | 6/2003 | McFarland et al. | 342/159 |
| 2004/0209594 | A1 * | 10/2004 | Naboulsi | 455/404.1 |
| 2005/0064914 | A1 * | 3/2005 | Gough | 455/567 |
| 2006/0212195 | A1 * | 9/2006 | Veith et al. | 701/35 |
| 2007/0032225 | A1 * | 2/2007 | Konicek et al. | 455/417 |
| 2007/0072616 | A1 * | 3/2007 | Irani | 455/441 |
| 2008/0268767 | A1 * | 10/2008 | Brown et al. | 455/1 |
| 2008/0268768 | A1 | 10/2008 | Brown et al. | 455/1 |
| 2009/0209196 | A1 * | 8/2009 | Haverty | 455/1 |
| 2010/0234047 | A1 * | 9/2010 | Lipovski | 455/456.4 |
| 2011/0053612 | A1 * | 3/2011 | Lipovski | 455/456.4 |

OTHER PUBLICATIONS

U.S. Appl. No. 12/109,266, filed Apr. 24, 2008, Brown et al.
U.S. Appl. No. 12/110,060, filed Apr. 25, 2008, Brown et al.

* cited by examiner

*Primary Examiner* — Tan Trinh
(74) *Attorney, Agent, or Firm* — Seed IP Law Group PLLC

(57) ABSTRACT

An apparatus operable to disable operation of wireless communications devices, for use within a vehicle, includes a drive circuit coupled to at least one active antenna element to produce interference within at least one wireless communications band of frequencies in response to the wireless communications device transmitting at a transmission power above a defined power threshold for a defined amount of time. The interference may take the form of a bare carrier wave, or may take the form of noise, and is transmitted at sufficient power to interfere with communication between the wireless communications device and a destination device.

26 Claims, 12 Drawing Sheets

APPARATUS AND METHOD FOR INTERFERING WITH WIRELESS COMMUNICATIONS DEVICES IN RESPONSE TO TRANSMISSION POWER DETECTION

BACKGROUND

1. Field

This disclosure generally relates to the field of wireless communications, and more particularly to wireless communications devices used within vehicles.

2. Description of the Related Art

Wireless communications devices, for example cellular phones, satellite phones, pagers, text messaging devices, personal digital assistants (e.g., BLACKBERRY® and TREO®) and the like are becoming ubiquitous.

Such devices, and in particular cellular phones are currently being used by an increasing number of people while driving. Research studies have shown that cellular phone usage diverts the concentration or attention of the motorist from the road and significantly increases the likelihood of an accident. Some countries as well as several states in the Unites States have banned the usage of hand-held cell phone devices during driving. However, studies indicate that usage of hands-free cellular phones are almost as distracting as hand-held cellular phones. At least one study suggests that hands-free cellular phone usage is almost the equivalent of driving while intoxicated.

Compliance with laws banning cellular phone usage appears to be low, and enforcement requires the diversion of police resources, which may otherwise be used to address other issues. Consequently, a new approach to addressing cellular phone usage in vehicles is therefore desirable.

BRIEF SUMMARY OF THE INVENTION

According to one aspect, an apparatus operable to disable operation of wireless communications devices prior to use within a vehicle includes at least one active antenna element, and a drive circuit coupled to drive the at least one active antenna element to produce interference within at least one wireless communications band of frequencies in response to the wireless communications device transmitting at a transmission power above a defined power threshold for a defined amount of time, wherein the interference is at sufficient power to interfere with communication between the wireless communications device and a destination device. The interference may take the form of a bare carrier wave (i.e., a carrier wave with no signal or noise imposed thereon), or may take the form of noise or a carrier wave imposed with noise.

According to another aspect, an apparatus operable to disable operation of wireless communications devices prior to use within a vehicle includes at least one active antenna element, and a drive circuit coupled to drive the at least one active antenna element to produce interference within at least one wireless communications band of frequencies in response to the wireless communications device transmitting at a transmission power above a defined power threshold for a defined amount of time while the vehicle is moving above a defined movement threshold, wherein the interference is at sufficient power to interfere with communication between the wireless communications device and a destination device.

According to another aspect, a method to disable operation of wireless communications devices prior to use within vehicles includes determining whether a transmission power of the wireless communications device is above a defined power threshold, determining a duration of time the transmission power of the wireless communications device is above the defined power threshold, and driving at least one active antenna element to produce interference within at least one wireless communications band of frequencies in response to a determination that the transmission power of the wireless communications device is above the defined power threshold for a duration of time that exceeds a defined time limit.

According to yet another aspect, a method to disable operation of wireless communications devices prior to use within vehicles includes determining whether the vehicle is moving above a defined movement threshold, determining whether the wireless communications device is transmitting at a transmission power above a defined power threshold for a defined amount of time, and driving at least one active antenna element to produce interference within at least one wireless communications band of frequencies in response to a determination that the transmission power of the wireless communications device is above the defined power threshold for the defined amount of time and in response to a determination that the vehicle is moving above the defined movement threshold.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various embodiments of the invention. However, one skilled in the art will understand that the embodiments may be practiced without these details. In other instances, well-known structures, equipment and processes associated with interfering with or jamming wireless communications, including voltage controlled oscillators, tuned circuits (e.g., LC circuits, RLC circuits), noise generators, RF (Radio Frequency) power amplification, antenna transmission and resulting structures have not been shown or described in detail to avoid unnecessarily obscuring the description.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combinable in any suitable manner in one or more embodiments.

The headings provided herein are for convenience only and do not interpret the scope or meaning of the claimed invention.

Figure 1A:
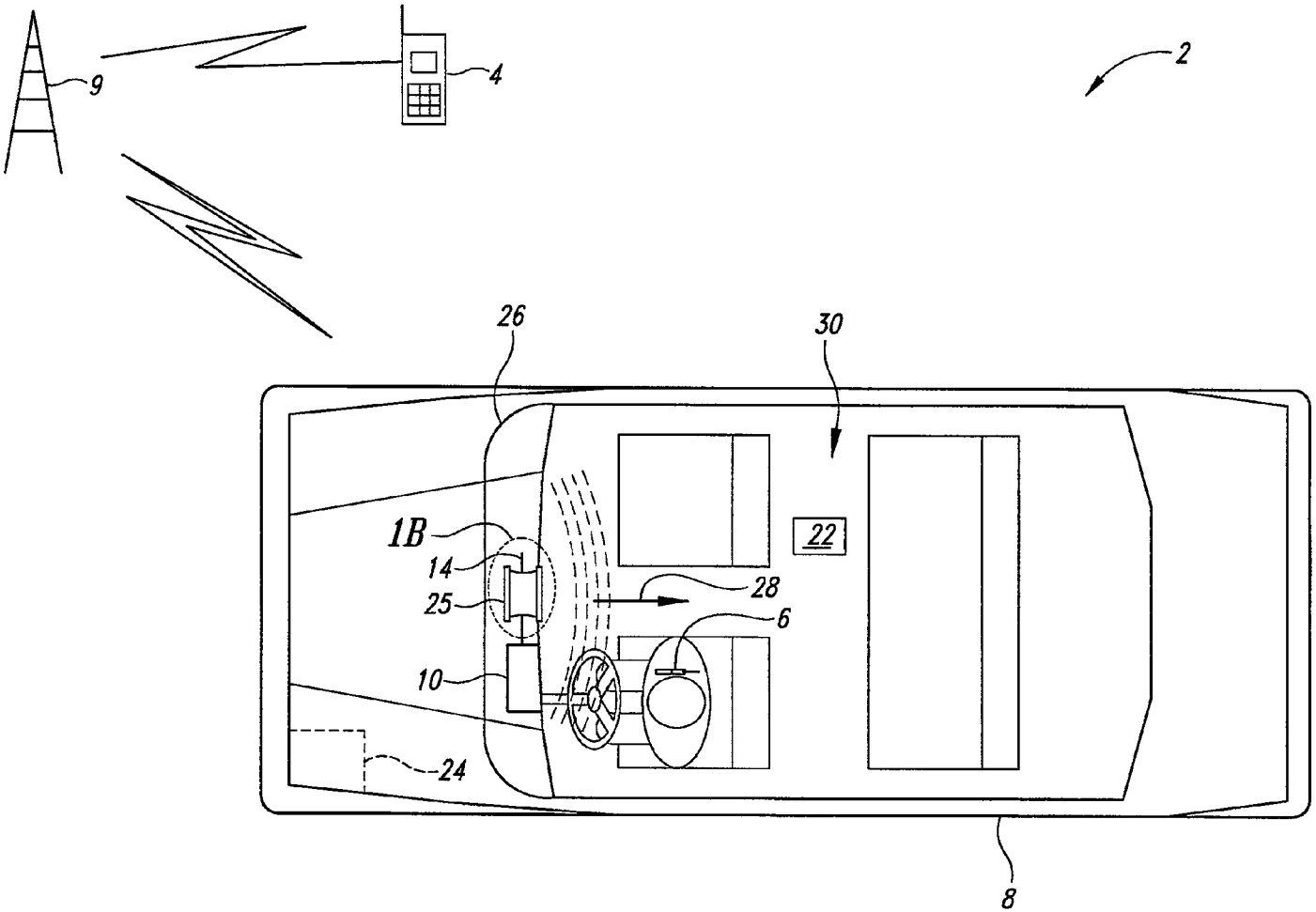
FIG. 1A is a schematic illustration of a communications system including an interference device positioned within a vehicle, according to one illustrated embodiment.

FIG. 1A is a schematic illustration of a communications system 2 as used with a vehicle 8, according to an illustrated embodiment.

The communications system 2 comprises a destination device 4 communicatively coupled to a wireless communications device 6 carried by the vehicle 8 via a base station 9 or some other communications switch. An interference device 10 is installed in or otherwise carried by the vehicle 8 or occupant thereof. The interference device 10 is operable to substantially interfere with communication between the destination device 4 and the wireless communications device 6 to a degree sufficient to effectively render the wireless communications device 6 inoperable.

The interference device 10 comprises a drive circuit 12 (FIGS. 2A-3B) electrically coupled to drive at least one active antenna element 14 to produce interference within at least one wireless communications band of frequencies. In some embodiments, the drive circuit 12 drives the active antenna element 14 to produce communications disabling interference in response to the wireless communications device 6 transmitting at a transmission power above a defined power threshold (e.g., 0.4 Watt, 0.3 Watt, 0.1 Watt, etc.) for a defined amount of time (e.g., 100 milliseconds, 50 milliseconds, 25 milliseconds, etc.). The defined power threshold and the defined amount of time may be defined via a power threshold input 16 and a timing input 18, respectively. In other embodiments, the drive circuit 12 drives the active antenna element 14 to produce communications disabling interference in response to the wireless communications device 6 transmitting at a transmission power above the defined power threshold for the defined amount of time while the vehicle 8 is moving above a defined movement threshold (e.g., 5 miles per hour, 2.5 miles per hour, etc.). The defined movement threshold may be defined via a movement threshold input 20. The interference device 10 may transmit a bare carrier wave or noise or undesired signal imposed on a carrier wave within one frequency band or automatically switch between transmission within two or more frequency bands that are likely to be used by the wireless communications device 6, as discussed below. Additionally or alternatively, the interference device 10 may periodically detect the frequency band used by the wireless communications device 6 and adjust itself accordingly.

The destination device 4 may, for example, be a further wireless communications device communicatively coupled to the wireless communications device 6 positioned within the vehicle 8. The interference may with wireless communications between the wireless communications device 6 and the base station 9 responsible for receiving and transmitting electromagnetic signals (e.g., radio frequency signals), for example, within a cellular region in which the wireless communications device 6 is located. The base station 9 may include a combination of antennas and electronic equipment used to receive and transmit the electromagnetic signals.

The wireless communications device 6 may take a variety of forms, for example, cellular phones, satellite phones, pagers, text messaging devices, personal digital assistants (e.g., BLACKBERRY® and TREO®). The wireless communications device 6 may transmit and receive electromagnetic signals within multiple bands of frequencies such as, for example, a 800 MHZ band, 900 MHz band, an 1800 MHz band, or a 1900 MHz band.

The vehicle 8 may be any suitable structure for transport on land, sea or in air, such as, for example, an automobile, truck, boat, submarine, plane, or helicopter. The vehicle 8 may include an RF (Radio Frequency) power sensor 22 to provide a signal indicative of the transmission power of the wireless communications device 6. Additionally, the vehicle 8 may also include a sensor 24 such as, for example, a speedometer, tachometer, acceleration sensor or a rotational encoder, to provide a signal indicative of movement of the vehicle 8. The signal may, for example, be indicative of change in position, rate of change in positions and/or rate of change in speed.

Figure 1B:
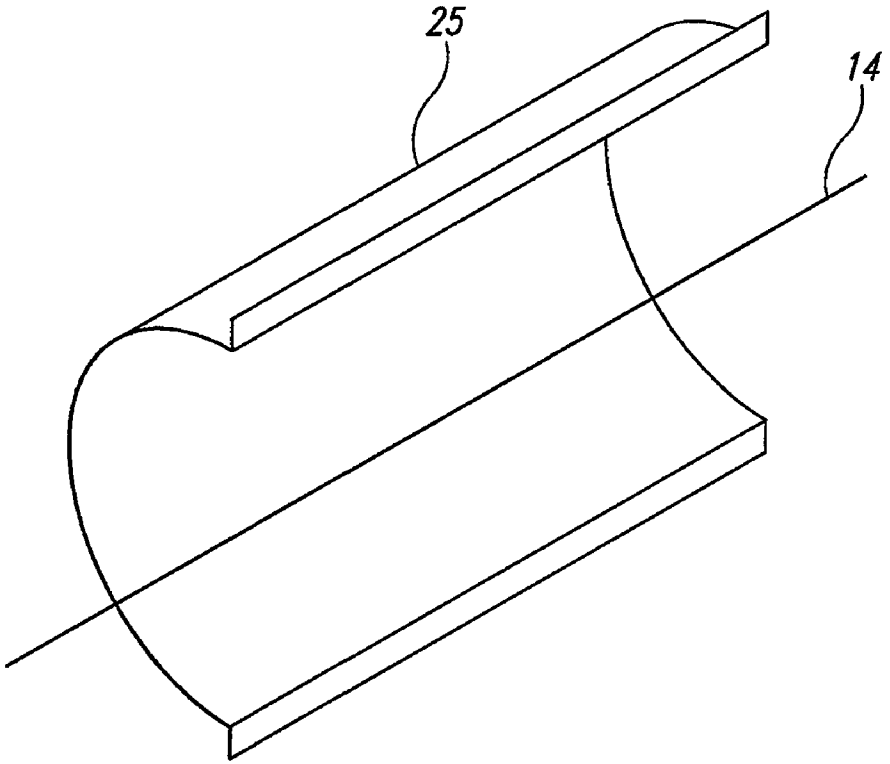
FIG. 1B is a detailed isometric bottom view of an active antenna element and a passive antenna element, according to one illustrated embodiment.

FIG. 1B shows a detailed isometric bottom view of the active antenna element 14 and a passive antenna element 25, according to one illustrated embodiment.

The active antenna element 14 may be a directional antenna element mounted proximate a dashboard 26 of the vehicle 8 (e.g., automobile) with a primary axis 28 of radiation directed into a passenger compartment 30 of the vehicle 8. In another embodiment, the passive antenna element 25 may be positioned with respect to the active antenna element 14 to produce a directional radiation pattern with the primary axis 28 of the directional radiation pattern directed into the passenger compartment 30 of the vehicle 8. The active antenna element 14 and the passive antenna element 25 are mounted proximate the dashboard 26 of the vehicle 8. As illustrated in FIG. 1B, the passive antenna element 25 may be formed as a portion of a cylinder, with a longitudinally extending slot extending a length thereof. The passive antenna element 25 may be inexpensively manufactured by a stamping and rolling process.

Figure 1C:
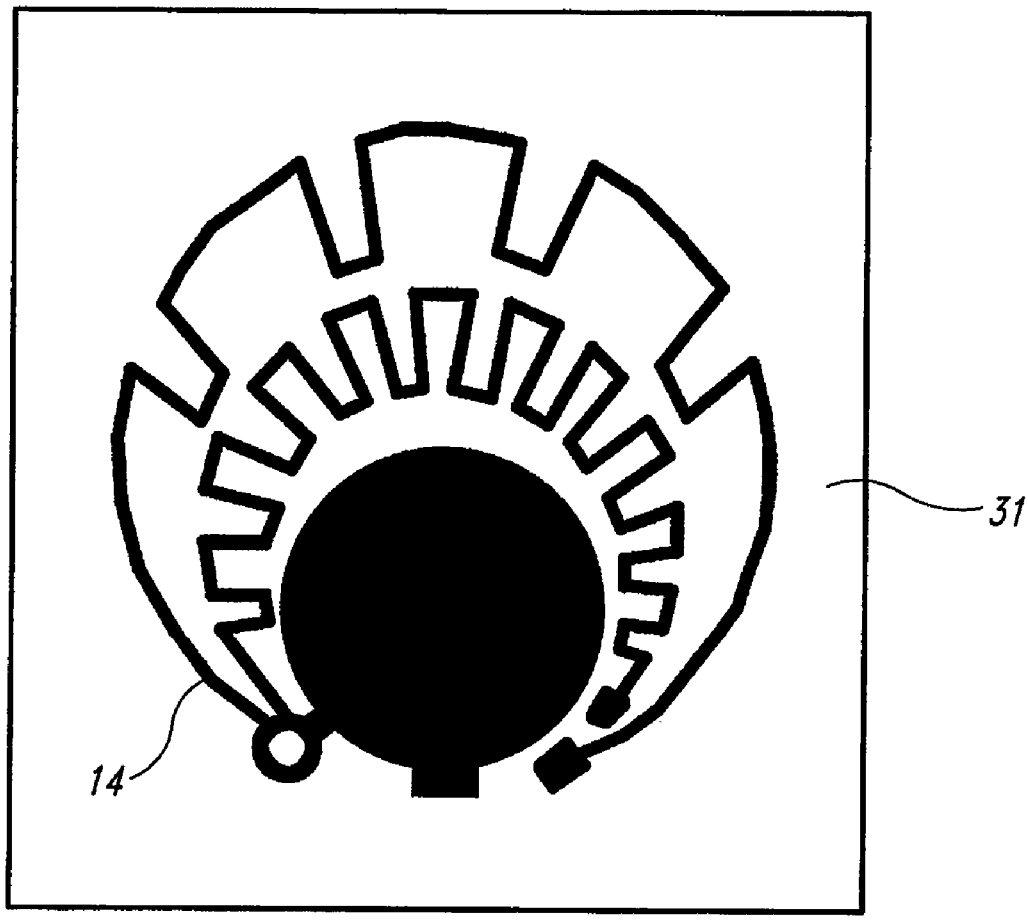
FIG. 1C is a schematic illustration of an active antenna element printed on a printed circuit board, according to one illustrated embodiment.

FIG. 1C shows a schematic illustration of the active antenna element 14 printed on a printed circuit board 31, according to one illustrated embodiment.

The active antenna element 14 may comprise conductive traces printed on a non-conductive substrate such as the printed circuit board 31. The active antenna element 14 may be designed as a dual-response Planar Inverted F-Antenna (PIFA) having a circular antenna design that is omni-directional with a reduced dB gain of approximately a few dB off the active antenna element 14 edges. The printed circuit board 31 with the active antenna element 14 printed thereon may be advantageously mounted perpendicular to the dashboard 26 or similar mountable surface so that the primary axis 28 of radiation may be directed into a driver side of the vehicle 8.

Figure 2A:
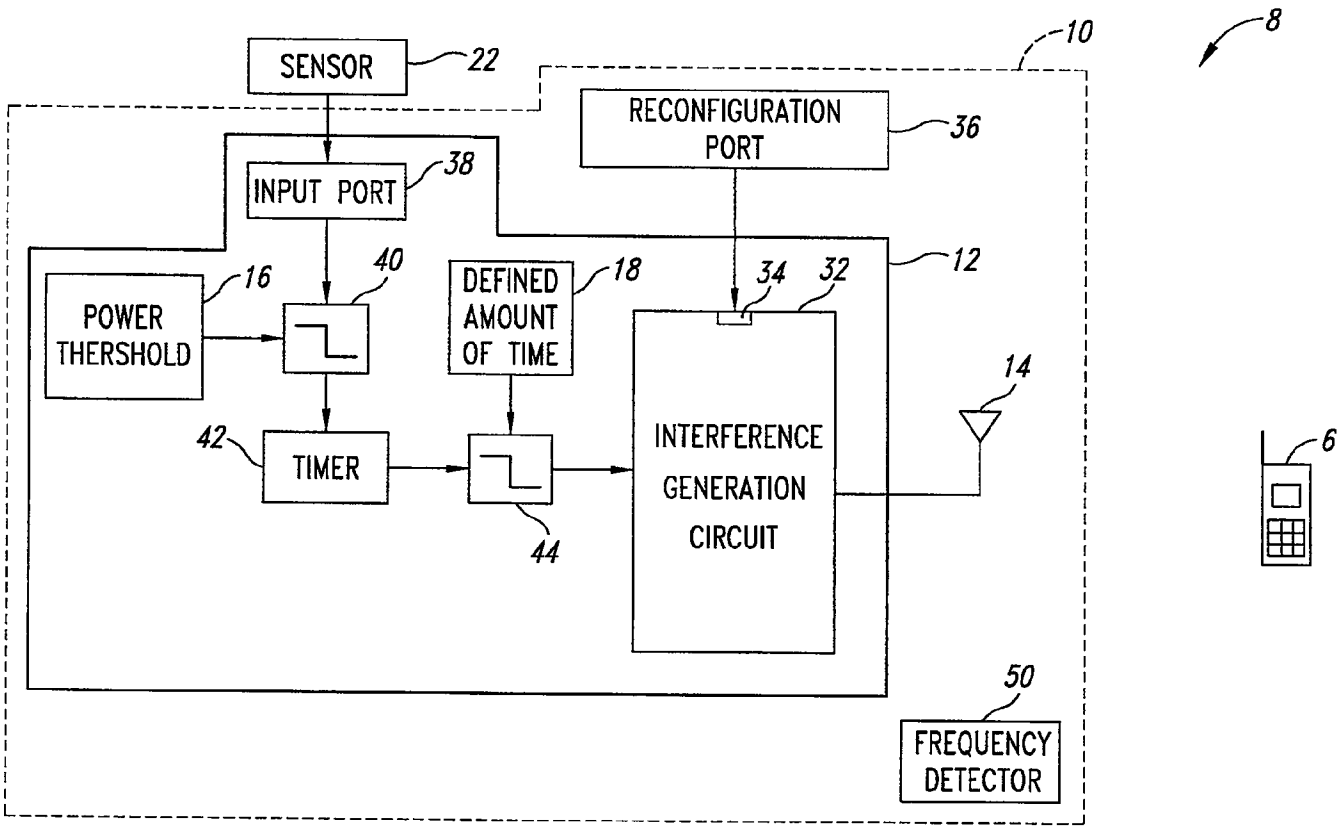
FIG. 2A is a schematic illustration of an interference device positioned within a vehicle and including a power detection circuit, according to one illustrated embodiment.
Figure 2B:
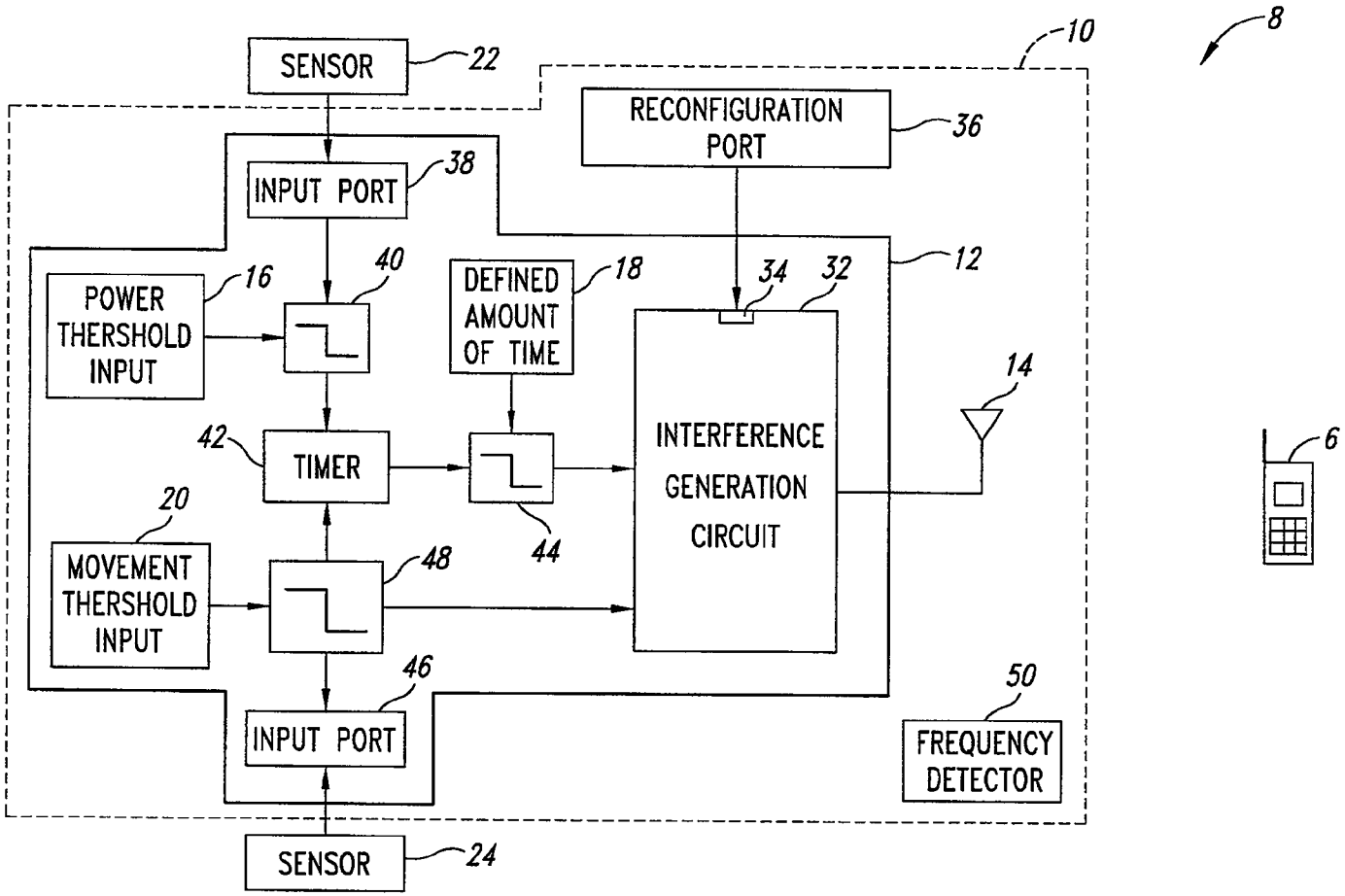
FIG. 2B is a schematic illustration of an interference device positioned within a vehicle and including a power detection circuit as well as a movement detection circuit, according to another illustrated embodiment.

FIGS. 2A-2B are schematic illustrations of the interference device 10 positioned within the vehicle 8, according to some illustrated embodiments.

The drive circuit 12 comprises at least one interference generation circuit 32 configured to cause the at least one active antenna element 14 to transmit interference (e.g., bare carrier wave, noise or undesired signal imposed on carrier wave) within the wireless communications band of frequencies. The frequency of operation of the interference generation circuit 32 may be implemented at manufacture, installation in the vehicle, on startup of the vehicle 8 and/or during use of the interference device 10. More specifically, the interference generation circuit 32 may include at least one variable circuit element 34 (e.g., inductor, capacitor, resistor, etc.) that may be varied according to input signals received via a reconfiguration port 36. The reconfiguration port 36 may receive a user defined input or a generated input based upon an anticipated or a detected frequency of operation of the wireless communications device 6. The reconfiguration port 36 may, for example, receive the user defined input during installation indicative of one or more frequency bands allocated to wireless communications in the geographic region in which the vehicle 8 or interference device 10 will be distributed, sold, operated and/or used. Alternatively, or additionally, the reconfiguration port 36 may for example receive the input generated in response to frequency detection. Such can accommodate new wireless communications devices and/or changes to existing wireless communications devices 6.

The interference generation circuit 32 may be electrically coupled to receive power via an electrical system of the vehicle 8. Alternatively, or additionally the interference generation circuit 32 may receive power via a power supply (e.g., a battery) or plugged into a standard electrical outlet.

The drive circuit 12 comprises a first input port 38 coupled to the RF power sensor 22 to receive the signal indicative of the transmission power of the wireless communications device 6. A first comparator 40 may be configured to compare the signal indicative of the transmission power of the wireless communications device 6 with the defined power threshold. A timer 42 coupled to the first comparator 40 is operable to determine an amount of time the transmission power is above the defined power threshold. A third comparator 44 is operable to compare the amount of time the transmission power is above the defined power threshold with the defined amount of time. In response to the transmission power of the wireless communications device 6 being above the defined power threshold for the defined amount of time, the drive circuit 12 drives the active antenna element 14 to produce interference. The interference device 10 transmits interference via the active antenna element 14 within the wireless communications band of frequencies, which approximately matches the frequency band used by the wireless communications device 6. The interference is transmitted at sufficient power to substantially interfere with communications between the wireless communications device 6 and the base station 9, and hence with the destination device 4. The base station 9 may, for example, be located less than approximately 22 meters from the wireless communications device 6. The defined power threshold may indicate a user set power threshold value while the defined amount of time may indicate a user set amount of time. For example, the user set power threshold value may be 0.1 Watts and the user set amount of time may be 100 milliseconds.

In some embodiments, as illustrated in FIG. 2B, the drive circuit 12 may further comprise a second input port 46 coupled to the sensor 24 to receive the signal indicative of movement of the vehicle 8. A second comparator 48 configured to compare the movement of the vehicle 8 with the defined movement threshold may be included in the drive circuit 12. Thus, according to such embodiments the drive circuit 12 drives the active antenna element 14 to produce interference in response to the wireless communications device 6 transmitting at a transmission power above the defined power threshold for the defined amount of time while the vehicle is moving above the defined movement threshold. The interference device 10 transmits interference via the active antenna element 14 within the wireless communications band of frequencies, which approximately matches the frequency band used by the wireless communications device 6. The interference is transmitted at sufficient power to substantially interfere with communication between the wireless communications device 6 and the base station 9, and hence with the destination device 4. The destination device 4 may, for example, be located less than approximately 22 meters from the base station 9. The defined movement threshold may indicate a user-defined movement threshold such as, for example, a speed threshold and/or an acceleration threshold and/or a change in position threshold. For example, the speed threshold may be a value indicative of a speed of approximately 5 miles per hour.

During manufacture, the interference generation circuit 32 may, for example, be configured to produce interference within the following frequency bands: 800 MHz band, 900 MHz band, 1800 MHz band, or 1900 MHz band. Prior to installation, the interference generation circuit 32 may be manually reconfigured based on the geographic location (e.g., Unites States, Europe, Japan, etc.) in which the vehicle 8 is sold, leased or operated, to interfere with one or more frequencies licensed for wireless communications in that area. Reducing the number of bands to only the bands that are licensed in the geographic location may advantageously reduce possible unintended interference with other devices, reduce power consumption, and/or comply with applicable laws or regulations.

As mentioned above, the reconfiguration port 36 may receive the generated input based upon the detected frequency of operation of the wireless communications device 6. For example, the drive circuit 12 may include an optional frequency detector 50 (e.g., RF signal analyzer) to detect the wireless communications band of frequencies used by the wireless communications device 6. The variable circuit element 34 of the interference generation circuit 32 is adjusted according to the input received via the reconfiguration port 36. The frequency detector 50 may be enabled at start-up of the vehicle 8 and/or periodically thereafter or at movement of the vehicle 8 above the defined threshold and/or periodically thereafter. The frequency detector 50 may be in constant detection mode irrespective of the movement of the vehicle 8. During enablement of the frequency detector 50 (e.g., at vehicle 8 start up and periodically thereafter), the reconfiguration port 36 receives the generated inputs from the frequency detector 50 indicating the current frequency band being used by the wireless communications device 6. The reconfiguration port 36 adjusts the variable circuit element 34 accordingly, so as to ensure that the generated interference interferes with the operation of the wireless communications device 6.

In another embodiment, the reconfiguration port 36 is programmed to automatically switch the adjustment of the variable circuit element 34 and cause the interference generation circuit 32 to cycle between several frequency bands to render the wireless communications device 6 ineffective without regard to the particular one of the licensed band or bands of frequency in which the particular wireless communications device 6 is operating. The possible frequency bands may be bands licensed for wireless communications in the geographic location in which the vehicle 8 is operated.

The interference generation circuit 32 may include a tuned circuit (e.g., RLC circuit, LC circuit, etc.) with an interference generator coupled thereto. The interference generator provides interference within one or more wireless communications bands of frequencies. The tuned circuit passes interference within the wireless communications band of frequencies that approximately matches the band of frequencies used during operation of the wireless communications device 6. The tuned circuit may include the variable circuit element 34 to allow for the selection of the new band of frequencies that approximately matches the wireless communications band of frequencies used during operation of the wireless communications device 6. The variable circuit component may be, for example, a varicap diode, integrated within the tuned circuit to form a voltage controlled oscillator (VCO). The varicap diode is a diode having a large depletion region that may be varied by an applied voltage, thereby functioning as a variable capacitor. The interference generation circuit 32 may further comprise an amplification circuit to increase the power of the transmitted interference. The amplification circuit provides sufficient power such that the transmitted interference interferes with the communication between the wireless communications device 6 and the destination device 4.

Figure 3A:
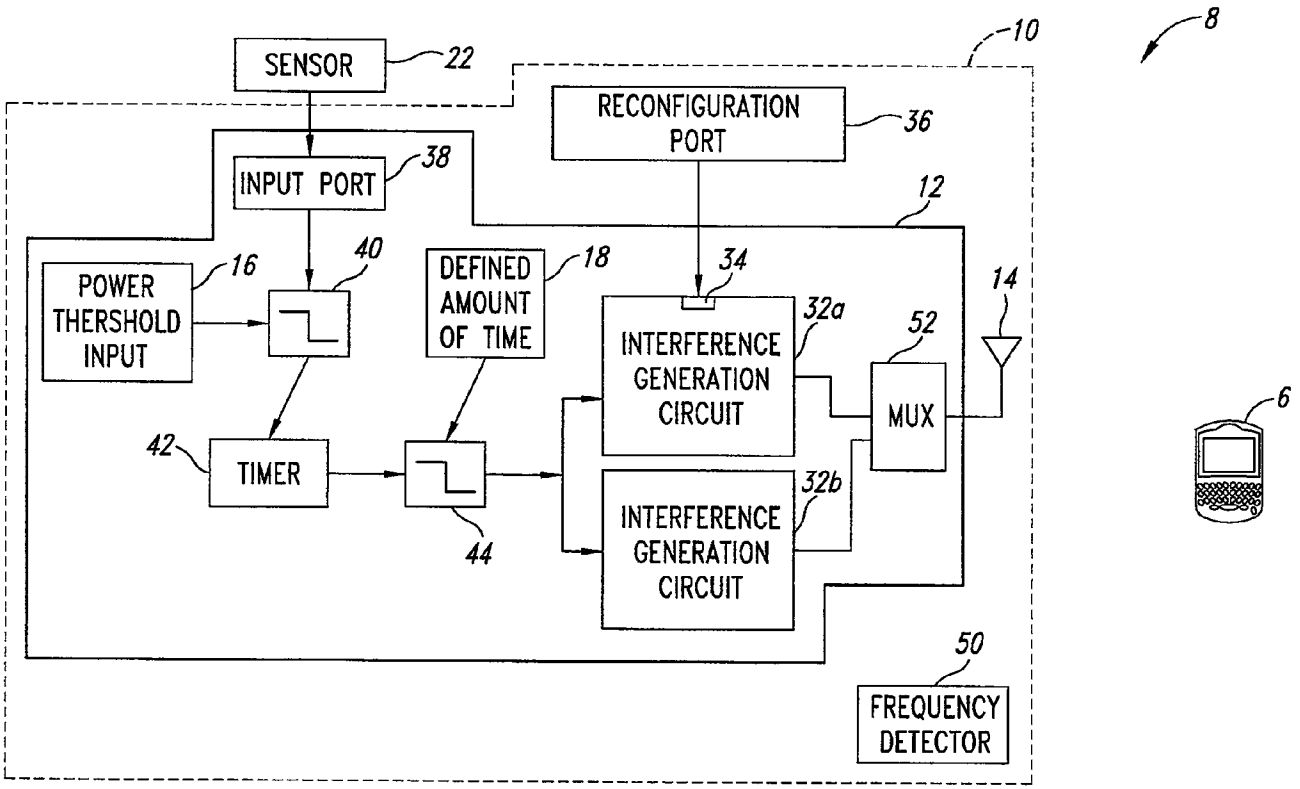
FIG. 3A is a schematic illustration of an interference device positioned within a vehicle including at least two interference generation circuits and a power detection circuit, according to one illustrated embodiment.
Figure 3B:
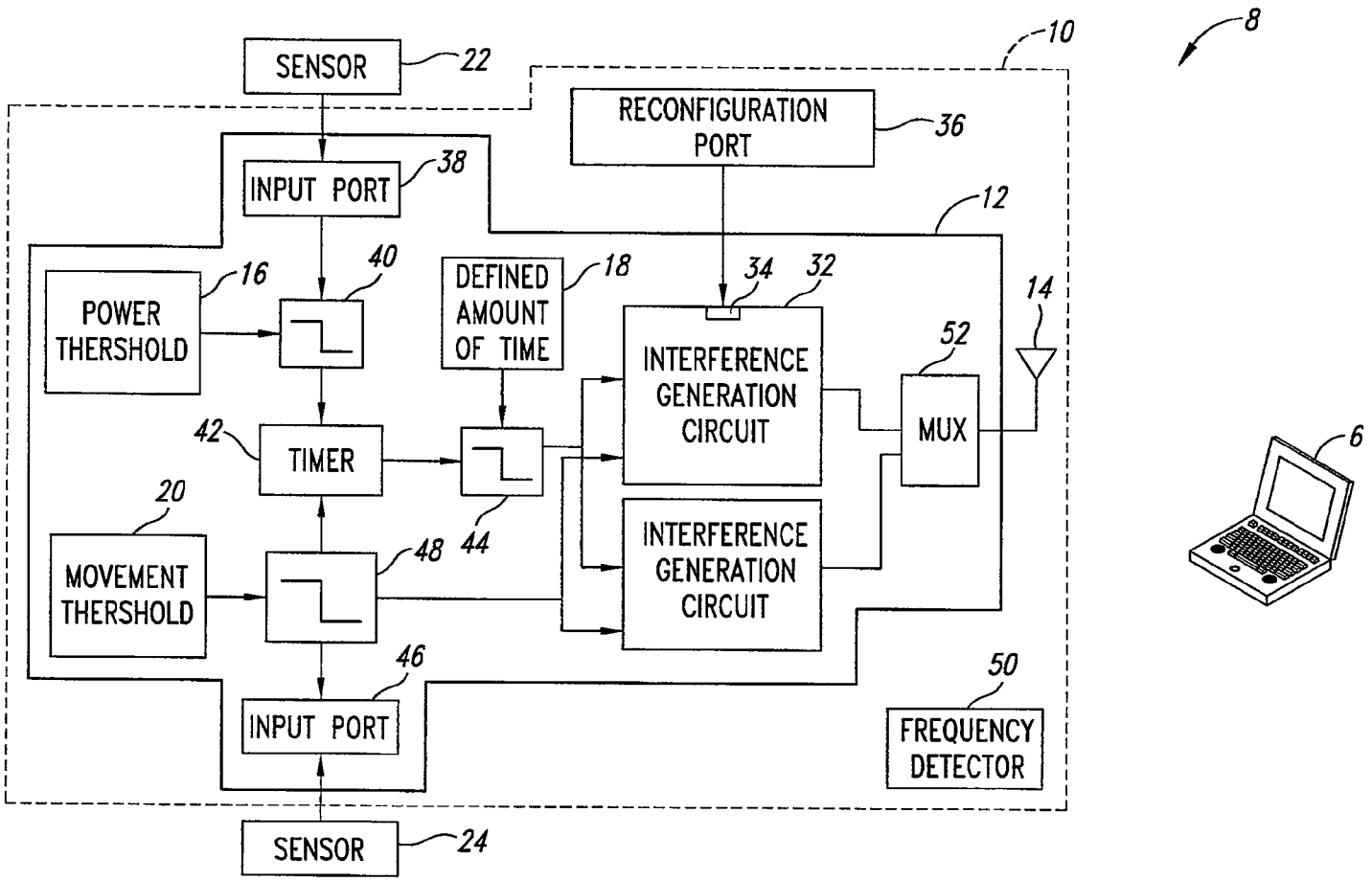
FIG. 3B is a schematic illustration of an interference device positioned within a vehicle including at least two interference generation circuits, a power detection circuit and a movement detection circuit, according to another illustrated embodiment.

FIGS. 3A and 3B show schematic illustrations of the interference device 10 positioned within the vehicle 8 and including at least two interference generation circuits 32*a*, 32*b* (collectively referenced as 32) and a multiplexer 52, according to an illustrated embodiment.

The drive circuit 12 of FIGS. 3A and 3B is similar in some respects to the drive circuit 12 of FIGS. 2A and 2B, respectively. Hence, identical or similar elements or components will be identified by the same reference numbers. Only significant differences in structure and operation are discussed below.

The multiplexer 52 is operable to selectively couple a respective one of the at least two interference generation circuits 32 to the active antenna element 14 at a time. Each of the at least two interference generation circuits 32 is operable to cause the active antenna element 14 to produce interference within a respective wireless communications band of frequencies. For example, the drive circuit 12 may include three interference generation circuits 32, wherein each is operable to cause the active antenna element 14 to produce interference within a respective one of three wireless communications bands of frequencies. The three bands of frequencies may include, for example, the 800 MHz band, 900 MHz band, 1800 MHz band and the 1900 MHz band, as configured during manufacture or installation of the interference device 10.

The third comparator 44 may trigger one or more of the interference generation circuits to generate interference when the transmission power of the wireless communications device is above the defined power threshold for the defined amount of time. In other embodiments, as shown in FIG. 3B, one or more of the interference generation circuits 32 are triggered based on both the second and the third comparators 48, 44 such that the interference generation circuits 32 generate interference in response to the transmission power of the wireless communications device 6 being above the defined power threshold for the defined amount of time while the vehicle 8 is moving above the defined movement threshold.

The interference signal is supplied to a respective input of the multiplexer 52. The multiplexer 52 selects the respective input corresponding to the interference generation circuit 32 to cause the active antenna element 14 to produce interference within the wireless communications band of frequencies that approximately matches the frequency band used by the wireless communications device 6.

In some embodiments, the drive circuit 12 may include the frequency detector 50 that detects the frequency band or bands in which the wireless communications device 6 is operating and supplies an appropriate signal to the multiplexer 52 to cause the multiplexer 52 to select the respective input. The respective input corresponds to the interference generation circuit 32 designed to produce interference within the wireless communications band of frequencies that approximately matches the frequency band used by the wireless communications device 6. Similarly to the interference device 10 of FIGS. 2A-2B, the frequency detector 50 may be enabled at start-up of the vehicle 8 and/or periodically thereafter or at transmission of the wireless communications device 6 above the defined power threshold for the defined amount of time and/or periodically thereafter or at transmission of the wireless communications device 6 above the defined power threshold for the defined amount of time while the vehicle 8 is moving above the defined movement threshold and/or periodically thereafter. The frequency detector 50 may be in constant detection mode irrespective of the power transmission of the wireless communications device 6 or the movement of the vehicle 8. During enablement of the frequency detector 50 (e.g., at vehicle 8 start up and/or periodically thereafter), the multiplexer 52 receives the signals from the frequency detector 50 to cause the multiplexer 52 to select the respective input. The respective input corresponding to the interference generation circuit 32 designed to produce interference to interfere with the current frequency band being used by the wireless communications device 6.

During manufacture, each of the interference generation circuits 32 may, for example, be configured to produce interference within the 800 MHz, 900 MHz, 1800 MHz or 1900 MHz bands, respectively. However, prior to installation, the multiplexer 52 may be manually set based on the geographic location (e.g., United States, Europe, Japan, etc.) in which the vehicle is sold, leased or operated, to select the input corresponding to the interference signal that can interfere with one or more frequencies licensed for wireless communications in that area.

Alternatively, the multiplexer 52 may be preprogrammed to automatically cycle selection between two or more inputs, effectively rendering the wireless communications device 6 ineffective without regard to the particular one of the licensed band or bands of frequency in which the particular wireless communications device 6 is operating. The two or more inputs may correspond to interference signals within respective frequency bands licensed for wireless communications in the geographic location in which the vehicle 8 is operated.

Similarly to the drive circuit 12 of FIGS. 2A and 2B, if neither of the interference generation circuits 32 produce interference within the frequency band used by the wireless communications device 6, the variable circuit element 34 of one of the interference generation circuits may be adjusted.

The reconfiguration port 36 may receive the user defined input (e.g., during installation) or the generated input based upon the detected frequency of operation of the wireless communications device 6. The reconfiguration port 36 may, for example, receive the user defined input during installation or the generated input during frequency detection.

Figure 4:
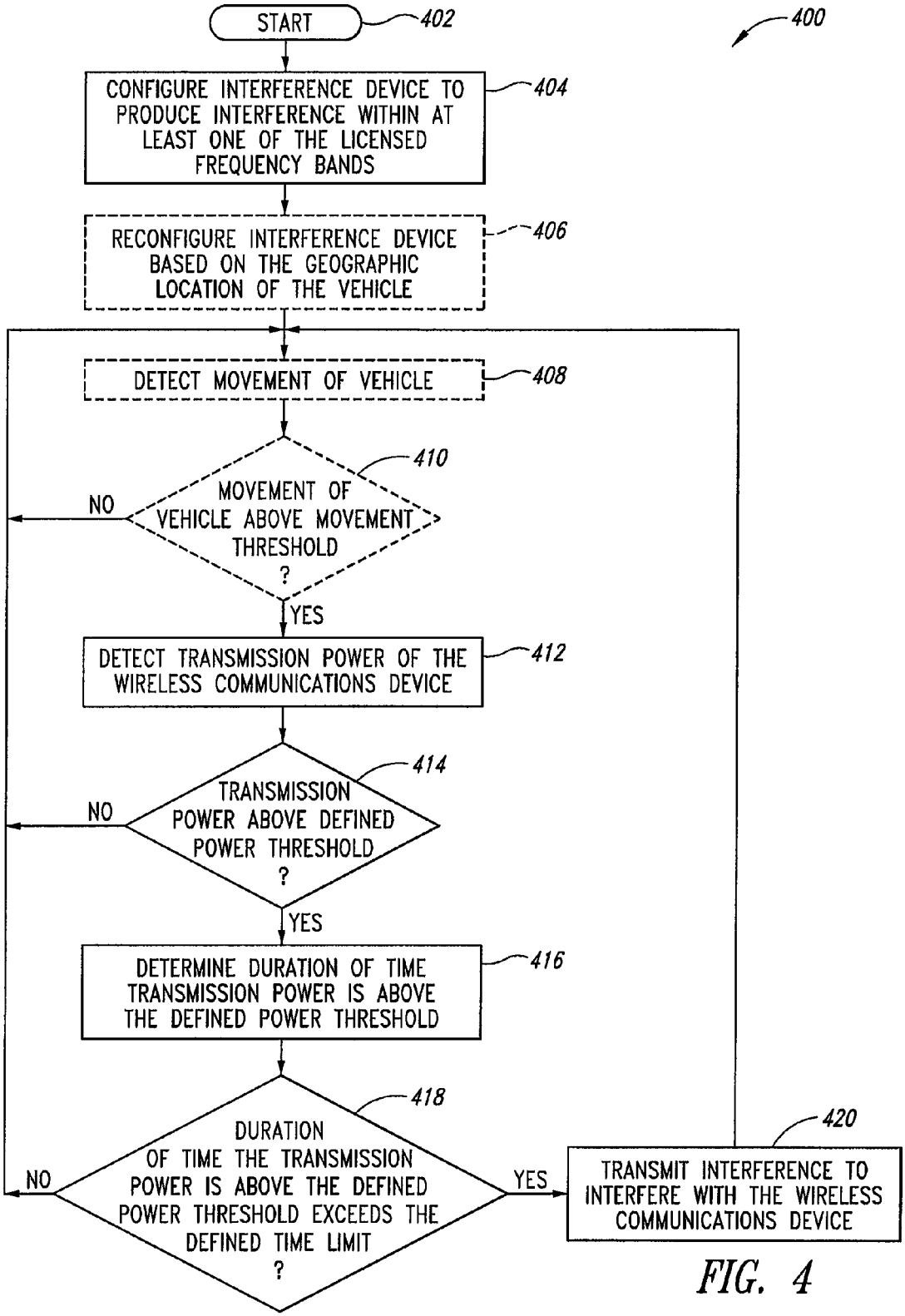
FIG. 4 is a flowchart of a method of disabling operation of wireless communications devices within the vehicle, according to one illustrated embodiment.

FIG. 4 shows a flowchart of a method 400 of disabling operation of the wireless communications device 6 within the vehicle 8, according to one illustrated embodiment.

The method 400 starts at 402, for example in response to the start of manufacture of the interference device 10. At 404, the interference device 10 is configured to produce interference within at least one of the frequency bands licensed for wireless communications in the geographic region in which the interference device 10 will be distributed, sold and/or used.

Optionally at 406, prior to installation of the interference device 10, the interference generation circuit 32 is manually configured based on the geographic location (e.g., Unites States, Europe, Japan, etc.) in which the vehicle 8 is sold, leased or operated, to interfere with one or more frequencies licensed for wireless communications in that area.

Optionally at 408, in response to the starting up or movement of the vehicle 8, the sensor 24 sends the signal indicative of the movement of the vehicle 8 to the drive circuit 12. The signal may be indicative of position, speed and/or acceleration of the vehicle 8 or a component thereof, for example, a drive shaft or axle.

Optionally at 410, the comparator 48 determines whether the movement of the vehicle 8 exceeds the defined movement threshold. As discussed above, the movement threshold may be defined via the movement threshold input 20. The signal indicative of the movement of the vehicle 8 is compared to the defined movement threshold. If it is determined that the vehicle 8 is moving below the defined movement threshold, control passes back to 408.

At 412, the RF power sensor 22 detects the transmission power of the wireless communications device 6 and provides the drive circuit 12 with the signal indicative of the transmission power of the wireless communications device 6. At 414, the comparator 40 determines whether the transmission power is above the defined power threshold (e.g., 0.1 Watt, 0.2 Watt, 0.3 Watt, etc.). The signal indicative of the transmission power is compared to the defined power threshold. If it is determined that the transmission power is below the defined power threshold, control passes back to 408.

At 416, the timer 42 is enabled and sends a signal indicative of the duration of time the transmission power is above the defined power threshold to the third comparator 44. The timer 42 remains enabled for the duration of time the transmission power remains above the defined power threshold. Optionally, the timer 42 remains enabled for the duration of time the transmission power remains above the defined power threshold while the vehicle 8 is moving above the defined movement threshold. If the transmission power subsequently drops below the defined power threshold or optionally if the vehicle 8 is moving below the movement threshold, the timer 42 is reset and disabled. The timer 42 is re-enabled when the transmission power subsequently rises back above the defined power threshold or optionally for the duration of time the transmission power remains above the defined power threshold while the vehicle 8 is moving above the defined movement threshold.

At 418, the third comparator 44 determines whether the signal indicative of the duration of time the transmission power is above the defined power threshold exceeds the defined time limit (e.g., 100 milliseconds). If the duration of time does not exceed the defined time limit, control passes back to 408.

At 420, the drive circuit 12 drives the active antenna element 12 to produce interference within at least one wireless communications band of frequencies in response to the determination that the transmission power of the wireless communications device 6 is greater than or equal to the defined power threshold for a duration of time that exceeds the defined time limit, which may optionally occur while the vehicle 8 is moving above the movement threshold. The at least one wireless communications band of frequencies approximately matches a frequency band used by the wireless communications device 6. The method 400 passes control back to 408.

It will be apparent to those of skill in the art, that the acts of the method 400 may be performed in a different order. It will also be apparent to those with skill in the art, that the method 400 omits some acts and/or may include additional acts.

Figure 5A:
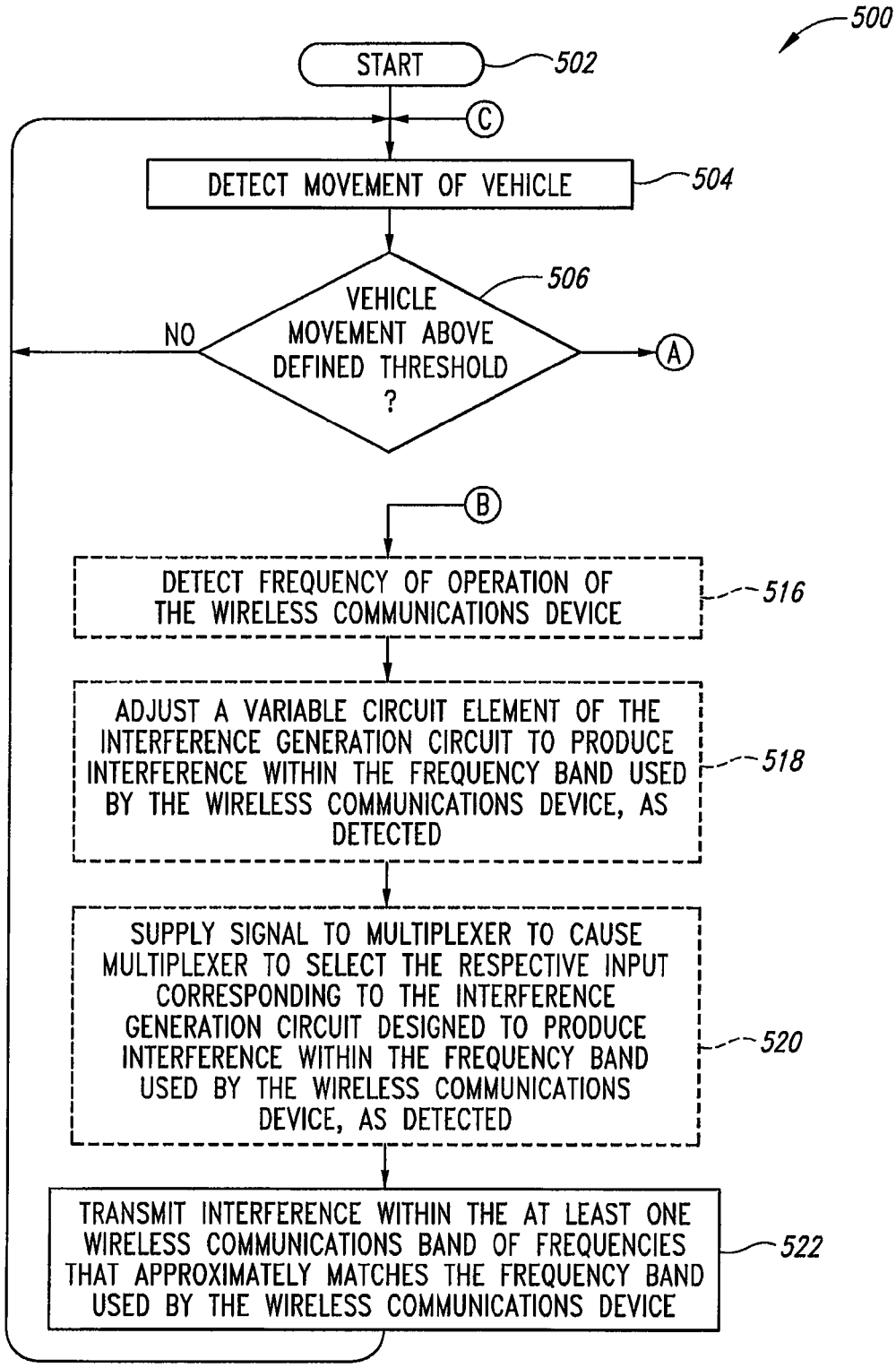
FIGS. 5A and 5B are a flowchart of a method of disabling operation of wireless communications devices within the vehicle, according to one illustrated embodiment.
Figure 5B:
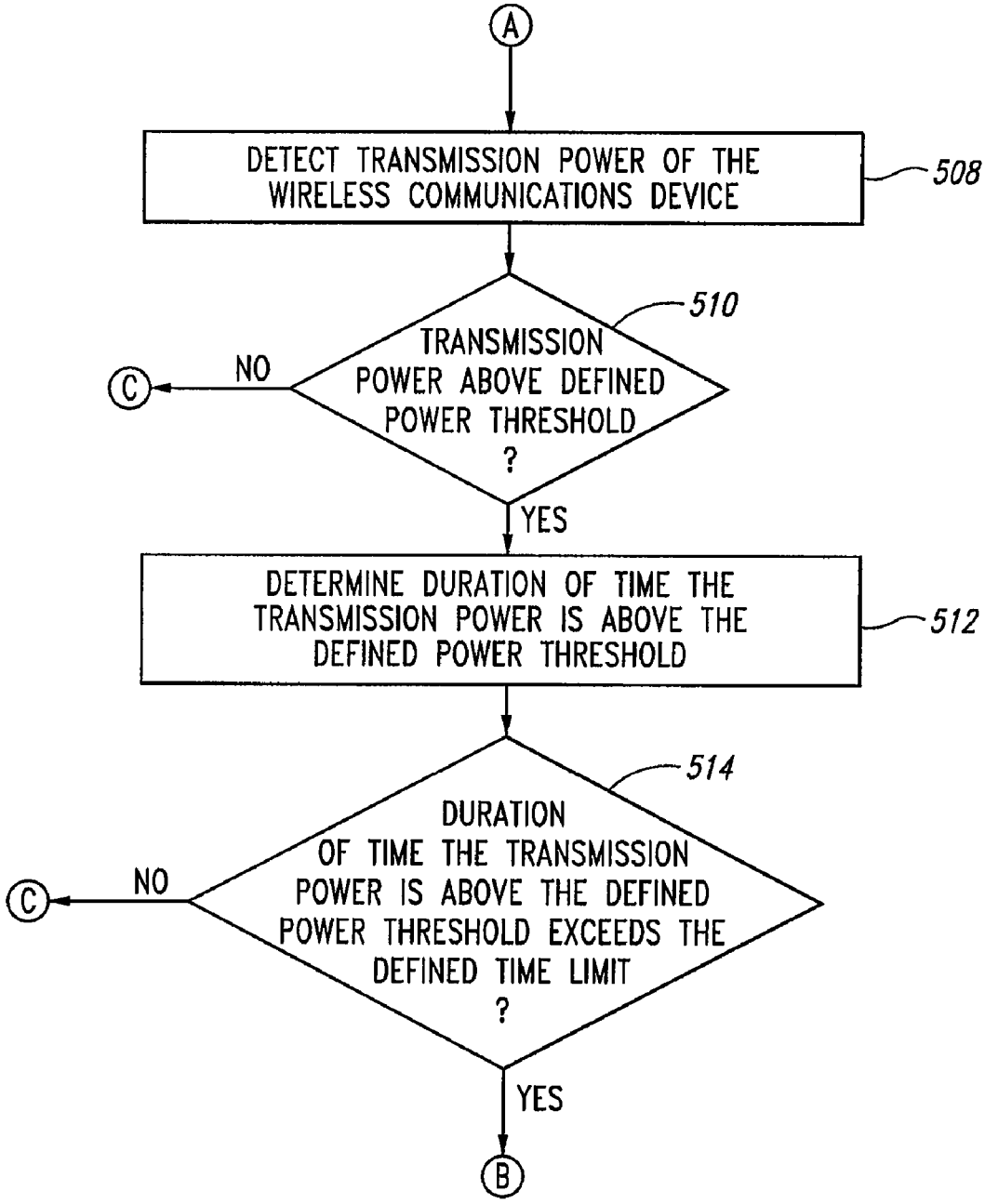

FIGS. 5A and 5B show a flowchart of a method 500 of disabling operation of the wireless communications devices 6 within the vehicle 8, according to one illustrated embodiment.

The method 500 starts at 502, for example in response to starting up or movement of the vehicle 8.

Optionally at 504, the sensor 24 sends the signal indicative of the movement of the vehicle 8 to the drive circuit 12. The signal may be indicative of position, speed and/or acceleration of the vehicle 8 or a component thereof, for example, a drive shaft or axle.

Optionally at 506, the comparator 24 determines whether the movement of the vehicle 8 exceeds the defined movement threshold. As discussed above, the movement threshold may be defined via the movement threshold input 20. As described above, the signal indicative of the movement of the vehicle 8 is compared to the defined movement threshold. If it is determined that the vehicle 8 is moving below the defined movement threshold, control passes back to 504.

At 508, the RF power sensor 22 detects the transmission power of the wireless communications device 6 and provides the drive circuit 12 with the signal indicative of the transmission power of the wireless communications device 6. At 510 the comparator 40 determines whether the transmission power is above the defined power threshold (e.g., 0.1 Watt, 0.2 Watt, 0.3 Watt, etc.). The signal indicative of the transmission power is compared to the defined power threshold. If it is determined that the transmission power is below the defined power threshold, control passes back to 504.

At 512, the timer 42 is enabled and sends a signal indicative of the duration of time the transmission power is above the defined power threshold to the third comparator 44. The timer 42 remains enabled for the duration of time the transmission power remains above the defined power threshold. Optionally, the timer 42 remains enabled for the duration of time the transmission power remains above the defined power threshold while the vehicle 8 is moving above the defined movement threshold. If the transmission power subsequently drops below the defined power threshold or optionally if the vehicle 8 is moving below the movement threshold, the timer 42 is reset and disabled. The timer is re-enabled when the transmission power subsequently rises back above the defined power threshold and optionally while the vehicle 8 is moving above the defined movement threshold.

At 514 the third comparator 44 determines whether the signal indicative of the duration of time the transmission power is above the defined power threshold exceeds the defined time limit (e.g., 100 milliseconds). If the duration of time does not exceed the defined time limit, control passes back to 504.

Optionally at 516, in the event that the wireless communications device 6 is in use, the frequency detector 50 detects the frequency of operation of the wireless communications device 6.

Optionally at 518, based upon a signal generated by the frequency detector, the at least one variable circuit element 34 of the interference generation circuit 32 is adjusted to produce interference within the at least one wireless communications band of frequencies that approximately matches the frequency band used by the wireless communications device 6, as detected.

Optionally at 520, a signal is supplied to the multiplexer 52, for example, from the frequency detector 50 to cause the multiplexer 52 to select the respective input corresponding to the interference generation circuit 32 designed to produce interference within the at least one wireless communications band of frequencies that approximately matches the frequency band used by the wireless communications device 6, as detected.

At 522, the comparator 24 triggers the interference generation circuit 32 to cause the active antenna element 14 to produce interference within the at least one wireless communications band of frequencies that approximately matches the frequency band used by the wireless communications device 6, as detected. The produced interference is in response to the determination that the transmission power of the wireless communications device 6 is greater than or equal to the defined power threshold for a duration of time that exceeds the defined time limit, which may optionally occur while the vehicle 8 is moving above the movement threshold. If there are at least two interference generation circuits 32 in the drive circuit 12 then the comparator 24 or may trigger each of the at least two interference generation circuits 32 to generate interference within the respective wireless communications band of frequencies to the respective input of the multiplexer 52. The multiplexer 52 selects the respective input corresponding to the interference generation circuit 32 designed to cause the active antenna element 14 to produce interference within the at least one wireless communications band of frequencies that approximately matches the frequency band used during operation of the wireless communications device 6. The interference is transmitted by the active antenna element 14 at sufficient power to interfere with communication between the wireless communications device 6 and the destination device 4. The destination device 4 may be located less than approximately 22 meters from the wireless communications device 6.

The method 500 passes control to 504 and waits for the transmission power to be above the power threshold for at least the defined time limit or optionally waits for the transmission power to be above the power threshold for at least the defined time limit while the vehicle 8 is moving above the movement threshold.

It will be apparent to those of skill in the art, that the acts of the method 500 may be performed in a different order. It will also be apparent to those with skill in the art, that the method 500 omits some acts and/or may include additional acts.

Figure 6A:
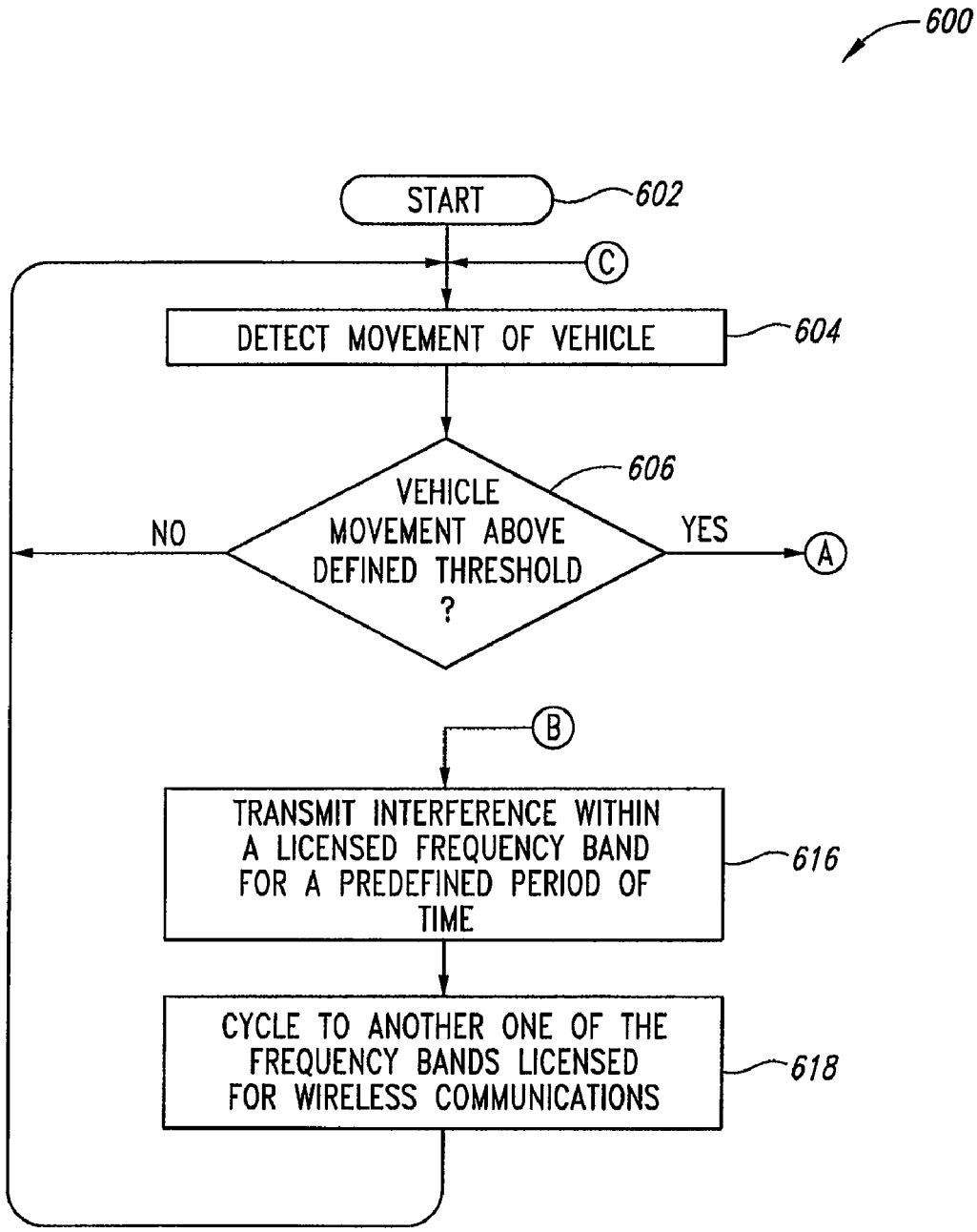
FIGS. 6A and 6B are a flowchart of a method of disabling operation of wireless communications devices within the vehicle, according to one illustrated embodiment.
Figure 6B:
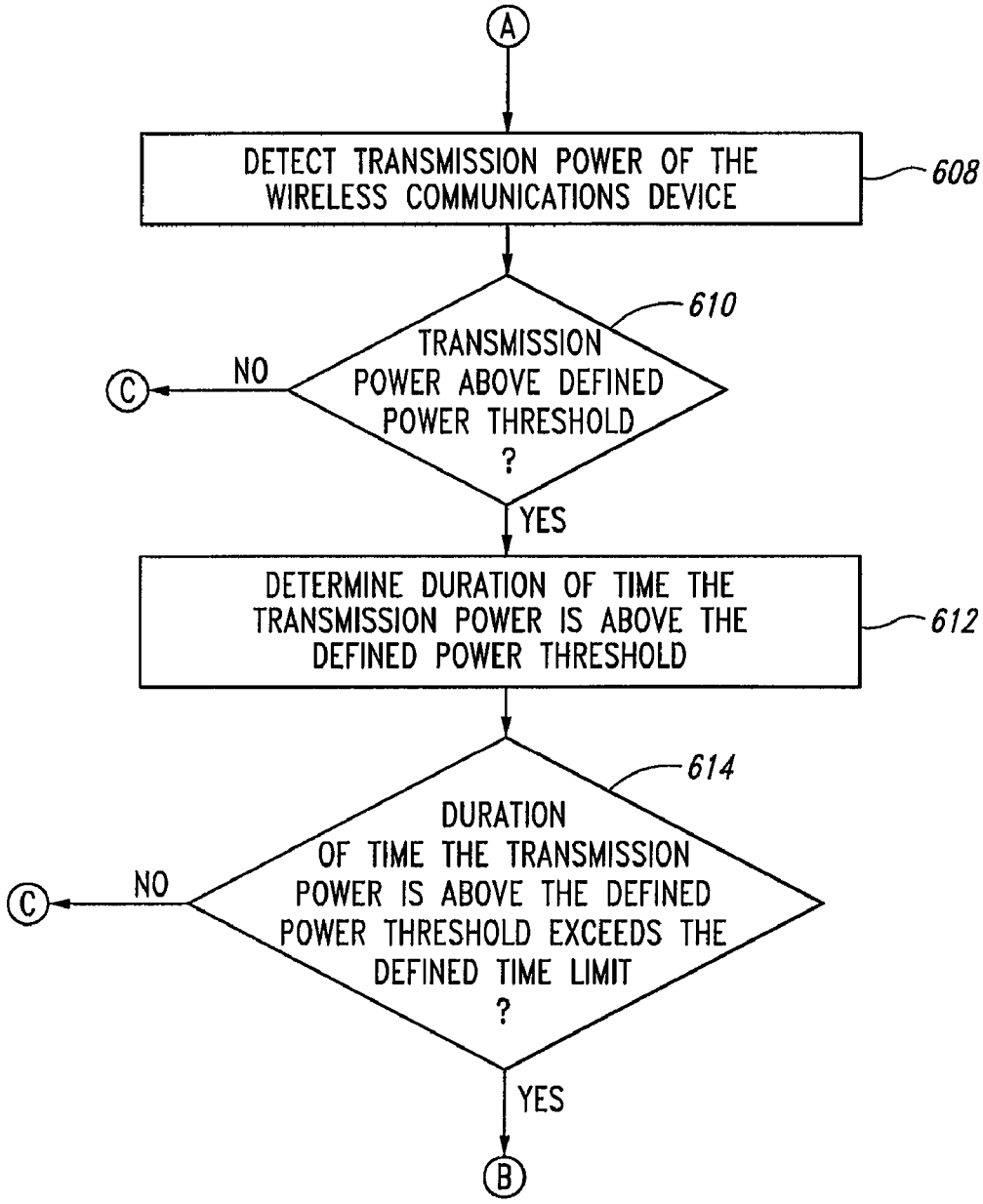

FIGS. 6A and 6B show a flowchart of a method 600 of disabling operation of the wireless communications devices 6 within the vehicle 8, according to one illustrated embodiment.

The method 600 starts at 602, for example in response to the starting up or movement of the vehicle 8. Optionally, at 604, the sensor 24 sends the signal indicative of the movement of the vehicle 8 to the drive circuit 12. The signal may be indicative of position, speed and/or acceleration of the vehicle 8 or a component thereof, for example, a drive shaft or axle.

Optionally, at 606, the comparator 24 determines whether the movement of the vehicle 8 exceeds the defined movement threshold. As discussed above, the movement threshold may be defined via the movement threshold input 20. The signal indicative of the movement of the vehicle 8 is compared to the defined movement threshold. If it is determined that the vehicle 8 is moving below the defined movement threshold, control passes back to 604.

At 608, the RF power sensor 22 detects the transmission power of the wireless communications device 6 and provides the drive circuit 12 with the signal indicative of the transmission power of the wireless communications device 6. At 610, the comparator 40 determines whether the transmission power is above the defined power threshold (e.g., 0.1 Watt, 0.2 Watt, 0.3 Watt, etc.). The signal indicative of the transmission power is compared to the defined power threshold. If it is determined that the transmission power is below the defined power threshold, control passes back to 604.

At 612, the timer 42 is enabled and sends a signal indicative of the duration of time the transmission power is above the defined power threshold to the third comparator 44. The timer 42 remains enabled for the duration of time the transmission power remains above the defined power threshold. Optionally, the timer 42 remains enabled for the duration of time the transmission power remains above the defined power threshold while the vehicle 8 is moving above the defined movement threshold. If the transmission power subsequently drops below the defined power threshold or optionally if the vehicle 8 is moving below the movement threshold, the timer 42 is reset and disabled. The timer is re-enabled when the transmission power subsequently rises back above the defined power threshold and optionally when the transmission power subsequently rises back above the defined power threshold while the vehicle 8 is moving above the defined movement threshold.

At 614, the third comparator 44 determines whether the signal indicative of the duration of time the transmission power is above the defined power threshold exceeds the defined time limit (e.g., 100 milliseconds). If the duration of time does not exceed the defined time limit, control passes back to 604.

At 616, the interference device 10 transmits interference within one of the frequency bands licensed for wireless communications in the geographic location in which the vehicle 8 is operated, in response to the determination that the transmission power of the wireless communications device 6 is greater than or equal to the defined power threshold for a duration of time that exceeds the defined time limit, which may optionally occur while the vehicle 8 is moving above the movement threshold. The interference device 10 transmits the interference within the selected frequency band for a predefined period of time.

At 618, the interference device 10 cycles to another one of the frequency bands licensed for wireless communications, different from the selected frequency band at 616.

The method 600 passes control to 604 and waits for the transmission power to be above the power threshold for at least the defined time limit or optionally waits for the transmission power to be above the power threshold for at least the defined time limit while the vehicle 8 is moving above the movement threshold.

It will be apparent to those of skill in the art, that the acts of the method 600 may be performed in a different order. It will also be apparent to those with skill in the art, that the method 600 omits some acts and/or may include additional acts.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A method to disable operation of wireless communications devices within vehicles, the method comprising:

determining whether a transmission power of the wireless communications device is above a defined power threshold;

determining a duration of time the transmission power of the wireless communications device is above the defined power threshold; and driving at least one active antenna element to produce interference within at least one wireless communications band of frequencies in response to a determination that the transmission power of the wireless communications device is above the defined power threshold for a duration of time that exceeds a defined time limit.

2. The method of claim 1 wherein determining whether the transmission power of the wireless communications device is above the defined power threshold for a duration of time that exceeds a defined time limit comprises receiving a signal from a sensor indicative of the transmission power of the wireless communications device and comparing the signal to the defined power threshold.

3. The method of claim 1 wherein determining whether the transmission power of the wireless communications device is above the defined power threshold for a duration of time that exceeds a defined time limit comprises receiving a signal from a timer indicative of the duration of time the transmission power of the wireless communications device is above the defined power threshold.

4. The method of claim 1 wherein determining whether the transmission power of the wireless communications device is above the defined power threshold for a duration of time that exceeds a defined time limit comprises receiving a signal from a timer indicative of the duration of time the transmission power of the wireless communications device is above the defined power threshold of approximately 0.1 Watts.

5. The method of claim 1 wherein determining whether the transmission power of the wireless communications device is above the defined power threshold for a duration of time that exceeds a defined time limit includes comparing the duration of time the transmission power is above the defined power threshold with the defined time limit.

6. The method of claim 1 wherein determining whether the transmission power of the wireless communications device is above the defined power threshold for a duration of time that exceeds a defined time limit includes comparing the duration of time the transmission power is above the defined power threshold with the defined time limit of approximately 100 milliseconds.

7. The method of claim 1 wherein driving the at least one active antenna element to produce interference within at least one wireless communications band of frequencies comprises driving the at least one active antenna element to produce interference within at least two distinct wireless communications bands of frequencies.

8. The method of claim 1 wherein driving at least one active antenna element to produce interference within at least one wireless communications band of frequencies comprises selectively coupling a respective one of at least two interference generation circuits to the active antenna element at a time.

9. The method of claim 1 wherein driving at least one active antenna element to produce interference within at least one wireless communications band of frequencies comprises driving the at least one active antenna element to produce interference within a new wireless communications band of frequencies, different from the at least one band of wireless communications frequencies in response to a reconfiguration input.

10. The method of claim 1 wherein driving at least one active antenna element to produce interference within at least one wireless communications band of frequencies comprises producing a directional radiation pattern from a position proximate a dashboard of the vehicle with a primary axis of the directional radiation pattern directed into a passenger compartment of the vehicle.

11. The method of claim 1 wherein driving at least one active antenna element to produce interference within at least one wireless communications band of frequencies comprises producing interference at sufficient power to interfere with communication between the wireless communications device and a destination device.

12. The method of claim 1 wherein driving at least one active antenna element to produce interference within at least one wireless communications band of frequencies comprises producing a bare carrier wave at sufficient power to interfere with communication between the wireless communications device and a destination device.

13. A method to disable operation of wireless communications devices within vehicles, the method comprising:

determining whether the vehicle is moving above a defined movement threshold;

determining whether the wireless communications device is transmitting at a transmission power above a defined power threshold for a defined amount of time; and driving at least one active antenna element to produce interference within at least one wireless communications band of frequencies in response to a determination that the transmission power of the wireless communications device is above the defined power threshold for the defined amount of time while the vehicle is moving above the defined movement threshold.

14. The method of claim 13 wherein determining whether the wireless communications device is transmitting at the transmission power above the defined power threshold comprises receiving a signal from a sensor indicative of the transmission power of the wireless communications device and comparing the signal to the defined power threshold.

15. The method of claim 13 wherein determining whether the wireless communications device is transmitting at the transmission power above the defined power threshold for the defined amount of time comprises:

receiving a signal from a sensor indicative of the transmission power of the wireless communications device and comparing the signal to the defined power threshold;

receiving a signal from a timer indicative of a duration of time the transmission power of the wireless communications device is above the defined power threshold; and comparing the duration of time the transmission power of the wireless communications device is above the defined power threshold with the defined amount of time.

16. The method of claim 13 wherein determining whether the wireless communications device is transmitting at the transmission power above the defined power threshold for the defined amount of time comprises receiving a signal from a timer indicative of a duration of time the transmission power of the wireless communications device is above the defined power threshold of approximately 0.1 Watts.

17. The method of claim 13 wherein determining whether the wireless communications device is transmitting at the transmission power above the defined power threshold for the defined amount of time comprises comparing the duration of time the transmission power of the wireless communications device is above the defined power threshold with the defined amount of time of approximately 100 milliseconds.

18. The method of claim 13 wherein determining whether the vehicle is moving above the defined movement threshold comprises receiving a signal from a sensor of the vehicle indicative of a speed of the vehicle and comparing the signal indicative of the speed of the vehicle to a speed threshold.

19. The method of claim 13 wherein determining whether the vehicle is moving above the defined threshold comprises receiving a signal from a sensor of the vehicle indicative of an acceleration of the vehicle and comparing the signal indicative of the acceleration of the vehicle to an acceleration threshold.

20. The method of claim 13 wherein determining whether the vehicle is moving above the defined threshold comprises detecting an acceleration of the vehicle and comparing the acceleration of the vehicle to an acceleration threshold.

21. The method of claim 13 wherein driving the at least one active antenna element to produce interference within at least one wireless communications band of frequencies comprises driving the at least one active antenna element to produce interference within at least two distinct wireless communications bands of frequencies.

22. The method of claim 13 wherein driving at least one active antenna element to produce interference within at least one wireless communications band of frequencies comprises selectively coupling a respective one of at least two interference generation circuits to the active antenna element at a time.

23. The method of claim 13 wherein driving at least one active antenna element to produce interference within at least one wireless communications band of frequencies comprises driving the at least one active antenna element to produce interference within a new wireless communications band of frequencies, different from the at least one band of wireless communications frequencies in response to a reconfiguration input.

24. The method of claim 13 wherein driving at least one active antenna element to produce interference within at least one wireless communications band of frequencies comprises producing a directional radiation pattern from a position proximate a dashboard of the vehicle with a primary axis of the directional radiation pattern directed into a passenger compartment of the vehicle.

25. The method of claim 13 wherein driving at least one active antenna element to produce interference within at least one wireless communications band of frequencies comprises producing interference at sufficient power to interfere with communication between the wireless communications device and a destination device.

26. The method of claim 13 wherein driving at least one active antenna element to produce interference within at least one wireless communications band of frequencies comprises producing a bare carrier wave at sufficient power to interfere with communication between the wireless communications device and a destination device.

* * * * *